United States Patent [19]

Yargici

[11] 4,313,691

[45] Feb. 2, 1982

[54] LUBRICATION AND BEARING STRUCTURE FOR CONCENTRIC, INDEPENDENTLY ROTATING DRUM AND VIBRATORY SHAFT

[75] Inventor: Zekeriya Yargici, Roseville, Minn.

[73] Assignee: American Hoist & Derrick Company, St. Paul, Minn.

[21] Appl. No.: 152,649

[22] Filed: May 23, 1980

[51] Int. Cl.[3] ..... E01C 19/38

[52] U.S. Cl. ..... 404/117; 308/36.1

[58] Field of Search ..... 404/122, 117, 123, 121, 404/124; 308/36.1, 76, 78, 126, 127, 130; 184/11 A

[56] References Cited

U.S. PATENT DOCUMENTS

| | | | |
|---|---|---|---|
| 1,766,001 | 6/1930 | Planche | 184/13 R |
| 1,787,428 | 1/1931 | Fekete | 184/11 R |
| 2,809,078 | 10/1957 | Hartwig | 308/76 |
| 3,052,166 | 9/1962 | Thrun | 404/117 |
| 3,257,918 | 6/1966 | Garis | 404/117 |
| 3,301,349 | 1/1967 | Williams | 184/11 R |
| 3,741,343 | 6/1973 | Lindenfeld | 184/6.12 X |
| 3,741,669 | 6/1973 | Harris | 404/117 |
| 3,909,147 | 9/1975 | Takata | 404/117 |
| 4,262,978 | 4/1981 | Everett | 308/36.1 |

*Primary Examiner*—Nile C. Byers, Jr.

*Attorney, Agent, or Firm*—Kinney, Lange, Braddock, Westman & Fairbairn

[57] ABSTRACT

An earth compacting machine includes an earth contacting drum rotatably supported on at least one main drum support bearing mounted in a drum support assembly which is fixed to the machine frame. Means is provided to slowly rotate the drum with respect to the frame. There is a slow speed rotary seal between the drum support assembly and a main drum hub which extends outwardly from the drum. The interior of the drum support assembly, the rotary seal and an outer surface of the main drum hub form a first lubrication oil sump. Oil is introduced into this sump to cover a substantial lower portion of the main drum support bearing. A vibratory shaft bearing is mounted in a vibratory shaft bearing housing at each end of the drum. These shaft bearings support a vibratory shaft inside of the drum. Means opening through the main drum support bearing and the main drum hub is provided to rapidly rotate the vibratory shaft with respect to the drum. A cylindrical second oil sump is sealed to both of the vibratory shafts bearing housings to provide lubrication oil to each of the vibratory shaft bearings without the need for a high speed rotary seal between the vibratory shaft and the slower moving drum.

6 Claims, 4 Drawing Figures

FIG. 1
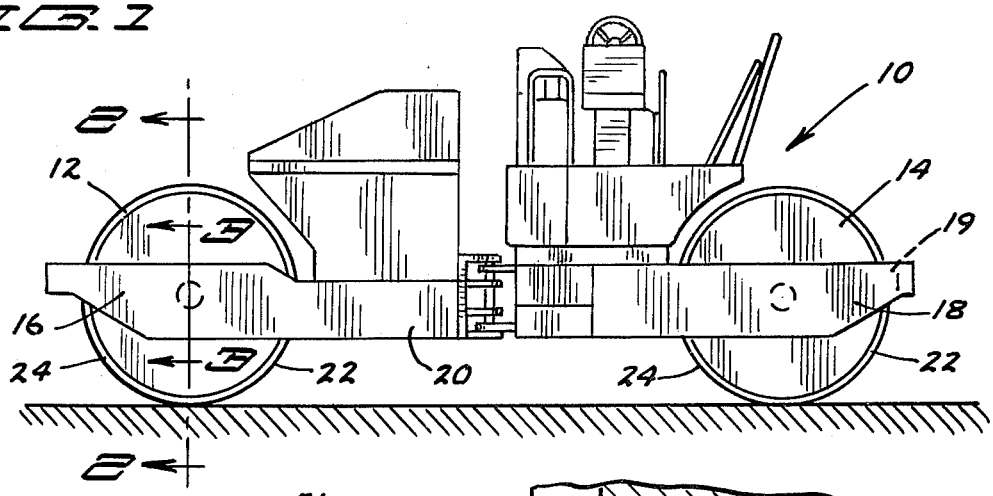
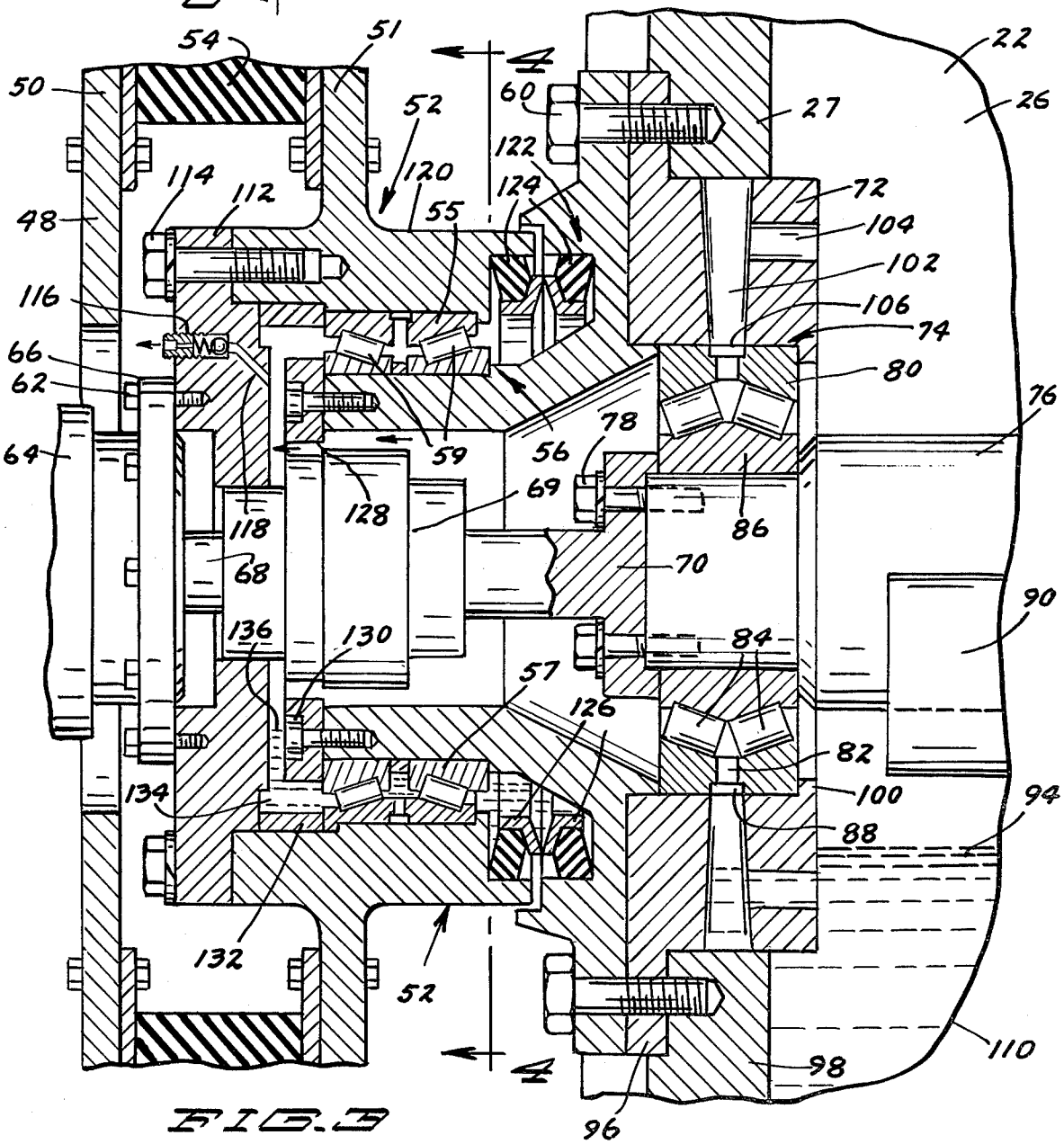
FIG. 3

LUBRICATION AND BEARING STRUCTURE FOR CONCENTRIC, INDEPENDENTLY ROTATING DRUM AND VIBRATORY SHAFT

BACKGROUND OF THE INVENTION

This invention has relation to the support and lubrication of main bearings designed to permit a road roller or drum to rotate at a relatively low speed with respect to the frame of a road, earth or other surface compacting machine and to the positioning of shaft bearings in concentric alignment with the main drum bearings to support a vibratory shaft within the drum to rotate at a relatively high speed, all without the need to provide a rotating seal between parts rotating at such relatively high speed with respect to each other.

Such structures normally utilize oil sumps or reservoirs from which the lubricating oil can be supplied to the bearings. In a typical structure, for example, the drum drive assembly for a Model CA-50 road roller manufactured by Vibro-Plus Products of Stanhope, N.J., each of the slow speed main drum bearings is fixedly supported with respect to one of the side frame plates of the machine. Drum end plates at each end of the drum each support a bell-shape closed oil sump. In each of these oil sumps, an eccentric shaft is rotatably mounted on a pair of high speed bearings, one set in the drum end plate and the other set in the wall of the bell-shape sump. A cylindrical drive shaft connects the two eccentric shafts, to thus form a compound drive shaft assembly. Driving one of the eccentric shafts from outside of the drum end plate at one end of the drum will cause the other eccentric shaft to be driven as well. This structure necessitates a high speed seal between the outer races each of the high speed vibratory shaft bearings situated in the wall of the oil sump and the compound vibratory drive shaft. Such high speed seals introduce a good deal of friction and heat and, therefore, wasted energy, into the driving of the vibratory shaft. These seals tend to wear out and break down rapidly, and, being situated in a space between opposite spaced apart drum end plates, are very, very expensive to repair and/or replace.

The structure of the present invention was developed to eliminate need for any high speed seal at all in such a structure, and to provide for positive lubrication of the relatively slow speed bearing forming the connection between the side frame plates of the machine and the road roller or drum at the end of the drum through which the vibratory shaft is driven.

A companion application, simultaneously filed, patent application Ser. No. 152,683, covers an invention whereby the vibratory shaft bearings themselves are positively lubricated utilizing gravity oil flow during the relatively slow rotation of the housing for those bearings with the road roller or drum.

A search of the prior art was made on the subject of positive lubrication of bearings for concentric rotating members and the following patents were located:

- U.S. Pat. No. 1,766,001 granted to Planche in June of 1930;
- U.S. Pat. No. 1,787,428 granted to Fekete et al in January of 1931;
- U.S. Pat. No. 3,301,349 granted to Williams in January of 1967; and
- U.S. Pat. No. 3,741,343 granted to Lindenfeld in June of 1973.

None is believed to be particularly pertinent to the present invention.

The inventor and those in privity with him know of no closer prior art than that set out above and know of no prior art which anticipates the claims made herein.

SUMMARY OF THE INVENTION

A road roller or drum is supported for relatively slow rotation with respect to the main frame of a compacting machine by main drum support bearings fixedly housed with respect to left and right side frame members of that machine through the instrumentality of left and right transversely extending drum end plates. At least one drum end plate is connected to one of said bearings through a main drum hub extending outwardly from the drum end plate.

A pair of high speed bearings are each mounted in a bearing housing which is fixed with respect to one of these right and left transversely extending drum plates. These bearings are concentric with the axis of the low speed main drum bearings. A shaft (in the form of the invention as shown a vibratory shaft) is rotatably mounted in these high speed bearings and is driven through the center of the main drum hub by a high speed (hydraulic vibratory) motor fixedly mounted with respect to the machine side frame member adjacent the main drum hub.

Means is provided for positively lubricating the high speed bearing as disclosed in the drawings herein, and as explained and claimed in my simultaneously filed patent application, above identified.

A high speed (vibratory) shaft drive and drum support assembly includes the high speed motor and is fixedly mounted with respect to the machine side frame member. A circular outer edge portion of the main drum hub and a facing, spaced-apart circular edge portion of a hub of the vibratory shaft drive and drum support assembly are located in relatively close but spaced relationship with respect to each other. A relatively low speed rotating oil seal is situated between these two parts. This seal, the outer periphery of the main drum hub and the interior surface of the drum support assembly define an oil sump. An access opening is provided through an upper portion of the drum support assembly to allow lubricating oil to be introduced into the sump to have position above a lowermost portion of the low speed bearing, thus insuring positive lubrication of that bearing at all times.

The high speed bearing including the bearing races are open from the inside of the drum through the space between the races of the high speed bearing into the area of the high speed shaft drive and drum support assembly. No high speed rotating oil seal need be provided between the high speed shaft and its stationary bearing housing.

At the other end of the high speed shaft, the bearing housing is capped with a drum end plate and a high speed bearing closure plate, so no high speed rotating lubrication oil seal is needed at that end either.

IN THE DRAWINGS

FIG. 1 is a side elevational view of an articulated earth compacting machine having double vibrating drums each rotatably supported for relatively slow movement over the ground and each supporting a rotating high speed vibratory shaft in concentric relationship with respect to its own axis of rotation;

FIG. 3 is a further enlarged fragmentary vertical sectional view taken on the line 3—3 in FIG. 1.

DESCRIPTION OF PREFERRED EMBODIMENT

Figure 2:
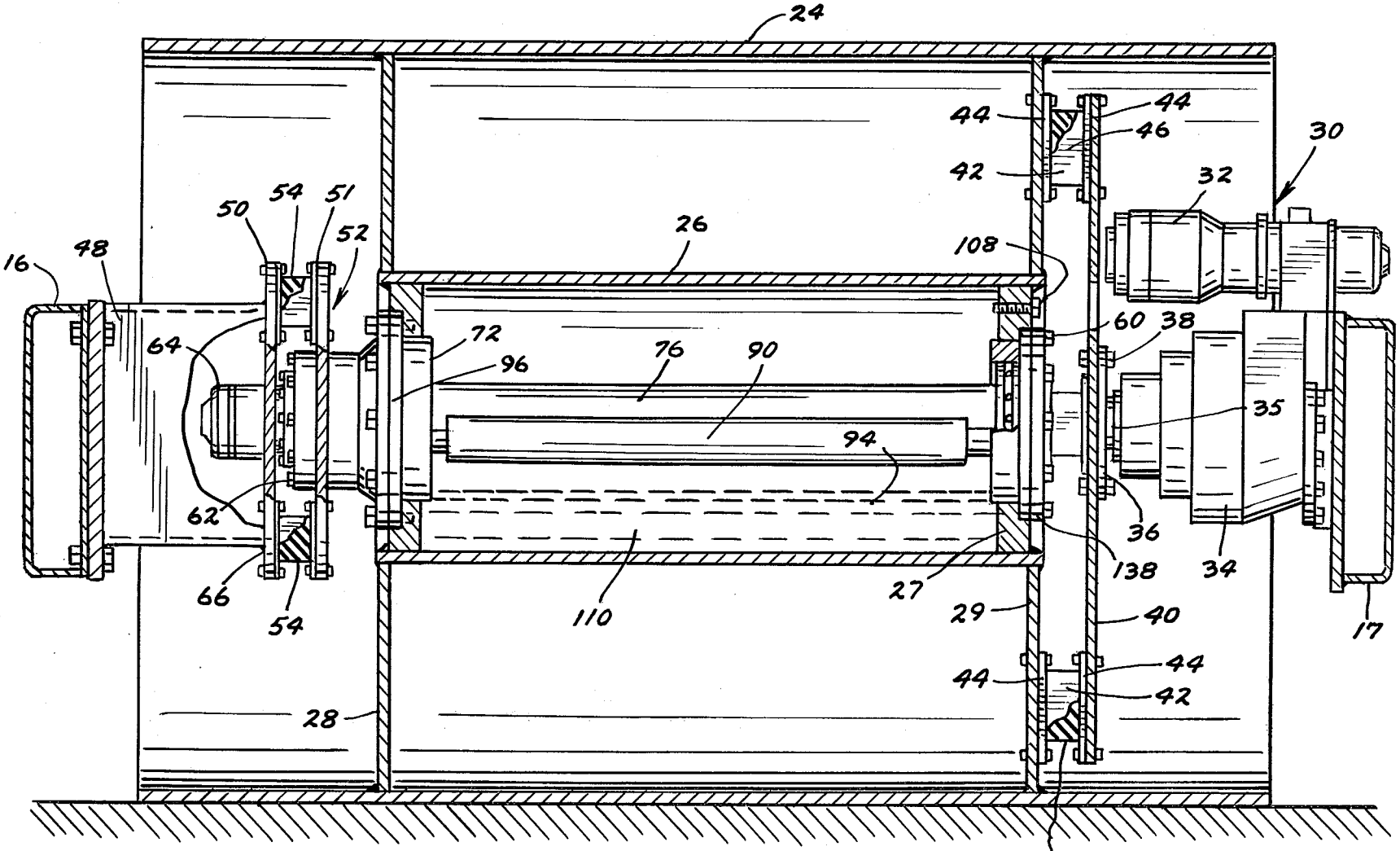
FIG. 2 is an enlarged vertical sectional view taken on the line 2—2 in FIG. 1.
Figure 4:
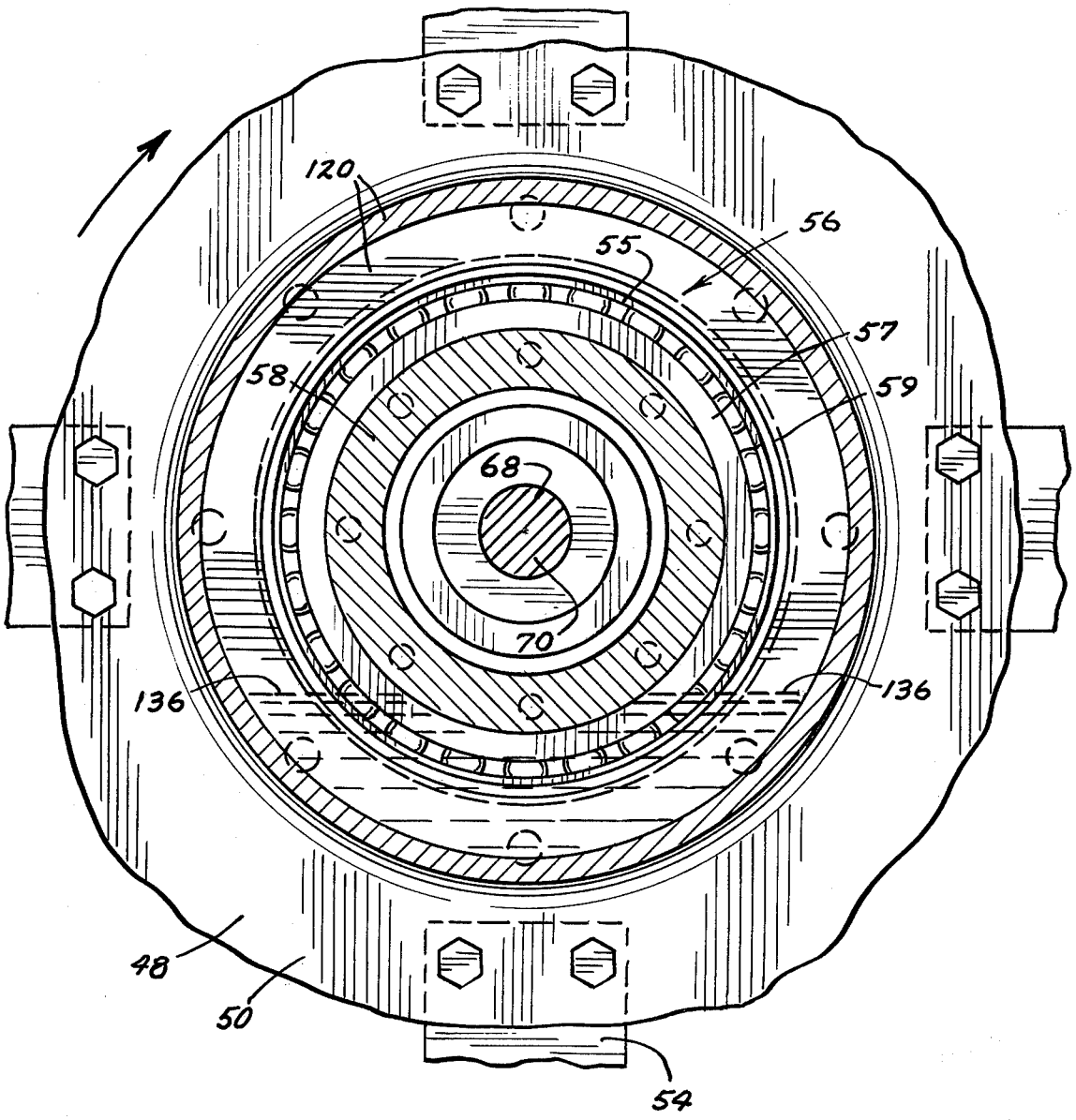
FIG. 4 is a vertical sectional view taken on the line 4—4 in FIG. 3.

A double drum articulated road, earth or other surface compacting machine 10 includes a front drum 12 and a rear drum 14 rotatably mounted between forward, parallel, spaced apart, side frame members 16 and 17 and rearward, parallel, spaced apart, side frame members 18 and 19, respectively, of an articulated main frame 20 of the compacting machine 10. The drums can be identical in structure, so only one of the drums, arbitrarily designated as front drum 12, will be described in detail.

The drums each consist of a main drum weldment 22 having an outer cylindrical ground-contacting shell 24, an inner cylindrical oil sump 26 concentric with the shell 24, a pair of disc shape transversely extending drum end plates 28 and 29 integrally connected between the outer shell 24 and the periphery of the oil sump 26, and a pair of oil sump end plates 27,27 at each end of the drum 12. As seen in FIG. 2, a front propel motor assembly 30 is integrally connected to the right forward side frame member 17 and includes hydraulic propel motor 32 and a propel gear box 34. A propeller shaft 35 extends inwardly from the gear box. Fastened to the propeller shaft 35 is a rotatable propel drive plate 36 which, when the propel motor 32 is appropriately activated, can be rotated forward or backward at between 20 to 30 revolutions per minute, for example, to move the machine over the surface to be compacted.

This drive plate 36 is bolted as at 38 to a drum support plate 40. This drum support plate is in turn connected to the right drum end plate 29 through the instrumentality of rubber shock mounts 42 as seen in FIG. 2. As shown, these shock mounts 42 include steel face plates 44,44 firmly bonded to a rubber shock absorbing block 46, but any other shock absorbing mountings sufficient to carry the load and dampen the shocks would suffice.

On the left side of the drum 12, as seen in FIG. 2, a drum support weldment 48 extends integrally inwardly from the forward side frame member 16 and includes a drum support plate 50 fixedly mounted with respect to the frame member 16. This drum support plate is connected to a vibratory drum support plate 51 of a vibratory shaft drive and drum support assembly 52 through the instrumentality of rubber shock mounts 54. These mounts can be similar in construction to rubber shock mounts 42 or can be of any other usual or preferred construction.

The vibratory shaft drive and drum assembly 52 houses a main drum support bearing 56 which includes an outer race 55 and an inner race 57. Main bearing rollers 59 run in these races.

Fixedly mounted in the inner race 57 is a main drum hub 58 which is bolted to the main drum weldment 22 at oil sump end plate 27 by bolts 60. This structure allows the drum 12 to support the left forward side frame member 16 of the articulated main frame 20 while at rest or while rotating relatively slowly with respect to the frame of the machine and the ground under motion imparted by and through the propel motor assembly 30.

Also bolted to the vibratory shaft drive and drum support assembly 52 as at 62 is a hydraulic vibratory motor 64 and its integral vibratory motor mounting plate 66. Vibratory motor 64 includes a vibratory motor drive shaft 68 which extends through a suitable coupling 69 to end in a vibratory motor drive shaft cap 70.

In addition to holding the main drum hub 58 in fixed relationship with respect to an oil sump end plate 27 of the main drum weldment 22, the bolt 60 also fixedly positions a combined vibratory shaft bearing housing and oil transfer fitting 72 in concentric relationship with respect to the axis of the drum 12 and the vibratory motor drive cap 70.

An outer race 80 of a vibratory shaft bearing 74 is fixedly mounted in the fitting 72 in adjacent relation to the main drum hub 58; and an inner race 86 supports one end of a vibratory shaft 76 for rotation with respect to the outer race and the main drum hub 58. The vibratory motor drive cap 70 is drivingly fastened to this end of the vibratory shaft 76 by bolts 78.

At the right end of vibratory shaft 76 as seen in FIG. 2, another vibratory shaft bearing housing and oil transfer fitting 72 is fastened to its oil sump end plate 27 of the main weldment 22 and this bearing housing and oil transfer fitting 72 similarly supports a vibratory shaft bearing 74 which in turn supports the vibratory shaft 76. The bearing housing and oil transfer fitting 72 at the right in FIG. 2 acts in a similar manner to that of the fitting 72 as seen on the left in FIG. 2 to positively supply lubricating oil to its bearing 74 in a manner now to be described.

The outer race 80 of each of the vibratory shaft bearings 74 is provided with a plurality of oil access holes 82 leading through the outer race 80 to bearing rollers 84 running between the bearing races 80 and 86. Outer race 80 is also provided with a lubricating channel 88 to distribute oil reaching it to all of the oil access holes 82, and thus to the rollers 84, insuring lubrication of the entire bearing.

Vibratory shaft 76 is provided with an offset weight 90 affixed to the shaft 76. One of the oil sump end plates 27 (the right end plate as seen in FIG. 2) is provided with a threaded opening to receive a threaded magnetic filler plug 108 which can be temporarily removed to permit introduction of lubrication oil 110 into the oil sump 26 up to a line indicated at 94 in FIGS. 2 and 3.

The bearing housing and oil transfer fitting 72 includes a radially outwardly extending flange 96 through which bolts 60 extend to fasten it and the main bearing hub 58 to end plate 27 of the main drum weldment. The housing 72 also includes a vibratory bearing housing receiving hub 98 situated back to back with the main drum hub 58. The bearing housing receiving hub 98 includes a bearing retaining lip 100, and the outer race 80 of the vibratory shaft bearing 74 is fixedly held between the main drum hub 58 and this retaining lip 100.

The hub 98 of the fitting 72 is provided with a series of wedge-shape pockets 102. Each such pocket is open to the interior of the oil sump 26 through an oil access port 104 in the hub 98, and each such pocket is open to the lubricating channel 88 in the outer race 80 of the vibratory shaft bearing 74 through an oil delivery port 106 in the hub 98.

Fastened to the vibratory drum support plate 51, and constituting part of the vibratory shaft drive and drum support assembly 52 is a drum support assembly cap 112. The drum support plate 51 and the drum support assembly cap 112 are maintained in sealing relationship with respect to each other through the instrumentality of bolts 114. As pointed out above, the vibratory motor mounting plate 66 is fixedly mounted in sealing relationship with respect to vibratory shaft drive and drum support assembly 52 and specifically the drum support assembly cap 112 through the instrumentality of bolts 62.

A one way pressure release valve 116 of any usual or preferred construction is situated in an opening 118 provided through an upper portion of the drum support assembly cap 112. The primary purpose of this valve 116 is to relieve any pressure building up inside drum 12; but this pressure release valve can be temporarily removed in order to allow lubrication oil 134 to be interjected through the drum support assembly cap 112 into the interior of the vibratory shaft drive and drum assembly 52 to bring the level of the oil up to the line indicated at 136 to insure proper and positive lubrication of the main drum support bearing 56.

As the front drum 12 rotates with respect to the forward side frame members 16 and 18, there will be relative motion between the main drum hub 58 and a hub 120 extending integrally and inwardly from the vibratory drum support plate 51 to form part of the drum support assembly 52. As pointed out above, the order of magnitude of this relative rotation is on the order of between 20 to 30 revolutions per minute.

A rotary oil seal 122 is provided between the hub 58 and the hub 120. Any kind of an effective relatively low speed oil seal will be suitable, but in the form of the invention as shown, two resilient rings 124,124 are each sealingly related to one of two metallic rings 126, 126. The resilient rings 124 force flat contacting faces of the metallic rings 126 into sealing contact with respect to each other. One of the resilient rings is mounted in a provided circular cavity in the hub 58 and the other is mounted in a provided cavity in the hub 120.

As seen in FIG. 2, the inner race 57 of the main drum support bearing 56 is held in place on the main drum hub 58 through the instrumentality of a main bearing retainer ring 128 and bolts 130. The outer race 55 of the main drum support bearing 56 is fixed in relationship to the vibratory drum support plate 51 through the instrumentality of a main bearing spacer ring 132.

Before the structure of the invention is put into operation, lubricating oil 134 is introduced through opening 118 in drum support assembly cap 112 to establish the oil level within the drum support assembly 52 as indicated at 136. This oil level is above the lowermost position of the inner race 57 of the main drum support bearing 56, so that as the inner race rotates with respect to the fixed outer race, oil on the bearing rollers 59 will be carried clear around the bearing to keep the main drum support bearing 56 properly and positively lubricated at all times.

On the right end of the main drum weldment 22, the vibratory shaft bearing housing and oil transfer fitting 72 is sealed off with a closure plate 138 through the instrumentality of bolts 60. Except for that, the structure of the vibratory shaft bearing housing 72 and its relationship to the vibratory shaft bearing 74 and the oil in the sump 26 is the same as described in connection with the left end of the drum 12.

It is often advantageous to apply a vibratory action to the outer shell 24 of each of the drums 12 and 14 at a rapid rate. For example, in a typical case, the hydraulic vibratory motor 64 can be operated to rotate the vibratory motor drive shaft 68 and, therefore, the vibratory shaft 76 at, say, for example, 2300 revolutions per minute.

When the earth compacting machine 10 is being moved from place to place under its own power, or at other times when vibratory action is not desirable, the vibratory motor will be inoperative, and the vibratory shaft 76 will have no relative motion with respect to the drum support weldment 48.

In other situations, the main drums can be rotated very, very slowly while the full speed vibratory action is continued.

In each of these situations, it is imperative that sufficient oil be supplied to the bearing rollers 84 of the vibratory shaft bearing 74 at each end of the vibratory shaft. This is positively accomplished using the apparatus of the invention.

OPERATION

Sufficient lubrication oil 110 for lubricating the bearings 74 will be introduced into the oil sump 26 to bring the upper surface of that oil to the depth indicated at line 94. This oil level is maintained below the lowest level reached by the offset weight 90 as it rotates in the oil sump. This prevents heating and foaming of the oil.

As more fully explained in simultaneously filed patent application Ser. No. 152,683, the oil 110 will enter each pocket 102 as the access port 104 of that pocket moves below the upper surface 94 of the oil. As the main drum weldment 22 rotates, some of the oil in the pocket will tend to flow back out through the access port, but since the access port is above the "bottom" of the pocket at this point, a considerable body of oil will remain in the pocket until such time as the oil delivery port 106 begins to become upright. At this point, the oil 110 will flow out of the delivery port 106 and into the lubricating channel 88 around the outer race 80 of the vibratory shaft bearing 74, and through oil access holes 82 of race 80.

When the main drum weldment is driven in reverse direction, the action of the oil in the sump 26, bearing housing and oil transfer fitting 72, and bearing 74 will be as described above but with the drum weldment 22 rotating in the opposite direction.

The construction of the structure is such that lubrication is provided for both the slower moving races of the main drum support bearing and the faster moving races of the vibratory shaft bearing without the necessity of having to provide any moving seal between the faster moving vibratory shaft and the slower moving main drum weldment.

The embodiments of the invention in which an exclusive property or privilege is claimed are defined as follows:

1. In a surface compacting machine including a main frame having parallel, spaced-apart side frame members, at least one hollow surface contacting drum rotatably mounted on a horizontal axis with the respect to said side frame members of said main frame, at least one shaft rotatably mounted within said drum on said horizontal axis, means to drive said drum at a relatively slow speed over a surface to be compacted, and means to drive said shaft separately from said drum to rotate at a relatively fast speed; the improvement including:

A. at least one drum support assembly fixedly mounted to one of said side frame members, said assembly being provided with a main bearing housing;

B. at least one main drum hub fixedly and concentrically associated with said drum;

C. a main drum support bearing fixedly mounted in said main bearing housing and rotatably supporting said main drum hub for rotation on said horizontal axis;

D. a rotary seal between said main bearing housing and an outer surface of said main bearing hub;

E. said drum support assembly, said rotary seal and a portion of said outer surface of said main bearing hub defining a first oil sump;

F. means to introduce a quantity of lubricating oil into said first sump to depth to immerse a substantial lower portion of the main drum support bearing;

G. a shaft bearing housing at each end of the drum concentrically and fixedly mounted with respect to the drum and in fixed relationship to and in concentric alignment with said main drum hub;

H. a shaft bearing fixedly mounted in each of said shaft bearing housings and rotatably supporting said shaft;

I. a cylindrical second oil sump inside of said drum in concentric relationship with respect to said drum and encompassing said shaft and shaft bearings and in sealing relationship to each of said shaft bearing housings;

J. means to introduce lubricating oil into said second sump; and

K. means to cause oil in said second sump to lubricate said shaft bearings.

2. The invention of claim 1 wherein:

L. the means to drive said shaft includes a shaft drive motor fastened to and forming a part of said drum support assembly; and M. said shaft drive motor has a drive shaft concentric with said horizontal axis, spaced from and extending through said main drum bearing and operably connected to an end of said shaft extending through and supported by one of said shaft bearings.

3. The invention of claim 2 wherein:

N. said means to introduce lubricating oil into said first sump includes an opening through an upper portion of said main bearing housing, and a one-way pressure relief valve in said opening.

4. The invention of claim 2 wherein:

N. only one drum support assembly is fixedly mounted to one of the side frame members;

O. a drum support plate is fixedly mounted with respect to said drum at an opposite end of said drum and in spaced relation to the other of said side frame members;

P. a propel motor assembly is fixedly mounted with respect to the other of said side frame members; and Q. said propel motor assembly includes a propeller shaft fixedly mounted with respect to said drum support plate in concentric relationship to said horizontal axis, and also includes means to drive said propel shaft to rotate said drum to drive said drum at a relatively slow speed over surface to be compacted.

5. The invention of claim 1 wherein:

L. said main drum support bearing is a bearing of the type having an outer race fixedly mounted in said main bearing housing and an inner race supporting said main drum hub for rotation with respect to the outer race.

6. The invention of claim 5 wherein:

M. said shaft bearings are of the type having an outer race fixedly mounted in its shaft bearing housing and having an inner race rotatably supporting said shaft for rotation with respect to said outer race.

* * * * *